US006419276B1

(12) United States Patent
Gatter et al.

(10) Patent No.: US 6,419,276 B1
(45) Date of Patent: Jul. 16, 2002

(54) COVERING ROSETTE

(75) Inventors: Raimond Gatter, Bretten; Hans-Hermann Hecker, Oberboihingen, both of (DE)

(73) Assignee: Hansa Metallwerke AG (DE)

( * ) Notice: Subject to any disclaimer, the term of this patent is extended or adjusted under 35 U.S.C. 154(b) by 0 days.

(21) Appl. No.: 09/447,905

(22) Filed: Nov. 23, 1999

(30) Foreign Application Priority Data

Nov. 23, 1998 (DE) ..... 198 53 951

(51) Int. Cl.[7] ..... E04F 19/00; F16L 5/00; F16L 55/00

(52) U.S. Cl. ..... 285/46; 285/39; 285/136.1; 285/64; 137/359; 210/460

(58) Field of Search ..... 285/46, 193, 189, 285/64, 379, 12; 4/696; 16/2.1; 137/359, 360, 356

(56) References Cited

U.S. PATENT DOCUMENTS 616,005 A * 12/1898 McGahan ..... 285/64
980,880 A * 1/1911 Mueller ..... 285/46
1,026,632 A * 5/1912 Mueller ..... 285/46
1,179,808 A * 4/1916 Cunningham ..... 285/136.1
2,202,049 A * 5/1940 Fitzgerald ..... 210/460
3,615,108 A * 10/1971 Toth ..... 285/46
3,823,964 A * 7/1974 Politz ..... 285/46
4,385,777 A * 5/1983 Logsdon ..... 285/12
5,161,567 A * 11/1992 Humpert ..... 137/359
5,236,229 A * 8/1993 Gonzalez ..... 285/46
5,427,417 A * 6/1995 Lechuga ..... 385/46
5,456,499 A * 10/1995 Sharpe ..... 285/39
5,497,584 A * 3/1996 Bergmann ..... 52/34
6,178,993 B1 * 1/2001 Oberdorfer ..... 137/359

* cited by examiner

*Primary Examiner*—Kathy Matecki
*Assistant Examiner*—Carlos Lugo

(57) ABSTRACT

A covering rosette for a sanitary flush-mounted fitting exhibits a covering plate, which is capable of being fastened to the flush-mounted fitting. An ornamental hood is detachably fastened to the covering plate by a latching device. The cover plate and the ornamental hood exhibit coaxial passage openings for a region of the flush-mounted fitting. The latching device exhibits a spring section comprising at least one elastically yielding spring tongue. The latching device retains the ornamental hood in such a manner that the connection brought about by the latching device is capable of being released by a tensile force acting away from the covering plant.

28 Claims, 9 Drawing Sheets

COVERING ROSETTE

CROSS REFERENCE TO RELATED APPLICATIONS

Not applicable.

STATE REGARDING FEDERALLY SPONSORED RESEARCH OR DEVELOPMENT

Not applicable.

BACKGROUND OF THE INVENTION

The invention relates to a covering rosette for a sanitary flush-mounted fitting with a covering plate which is fastened to the flush-mounted fitting and with an ornamental hood which is detachably fastened to the covering plate by means of a latching device, whereby covering plate and ornamental hood exhibit coaxial passage openings for a region of the flush-mounted fitting.

TECHNICAL FIELD

Covering rosettes of this type serve for protection of the flush-mounted fitting against spray and simultaneously serve to cover, in visually appealing manner, the transition region between the region of the flush-mounted fitting protruding from the wall and the wall section adjacent to this region.

A covering rosette of the type mentioned in the introduction is known from EP 0 485 842 B1. The covering rosette described therein comprises a covering plate which for the purpose of fastening is screwed onto the flush-mounted fitting, as well as an ornamental hood. The ornamental hood exhibits moulded-on pushbutton-type spigots, with which it locks in position in openings in the covering plate for detachable fastening by means of the latching device which is formed by the spigots and the openings.

A covering rosette of this type has the disadvantage that the elastic deformation path between the ornamental hood entering into the latching connection and the covering plate is very short. This necessitates a high dimensional accuracy of these components, in particular of the position and the dimensioning of the pushbutton-type spigots, in the course of manufacture, in order that the components fit together in the course of mounting of the covering rosette. Experience has shown that the elasticity of the latching connection which is highly stressed by reason of the short elastic deformation path is exhausted in the course of time by plastic deformation, as a result of which the connection may come loose in undesirable manner.

In addition, dismantling of covering rosettes of this type is made difficult by virtue of the fact that after the latching of ornamental hood and covering plate the covering rosette offers no defined working surface for dismantling the connection which has been brought about by the latching device. Dismantling of such a covering rosette can therefore result in damage to the ornamental hood and/or to the latching device and therefore in the unusability of the entire covering rosette.

SUMMARY OF THE INVENTION

The object of the present invention is therefore to configure a device of the type mentioned in the introduction in such a manner that the requirements as regards the dimensional accuracy of the constituents of the covering rosette are reduced, the elasticity of the latching device is permanently guaranteed and defined dismantling of the latching device is possible.

In accordance with the invention this object is achieved by the covering rosette exhibiting a spring section comprising at least one elastically yielding spring tongue, whereby said spring section retains the ornamental hood by means of the latching device which exhibits at least one latching projection in such a way that the connection brought about by the latching device is capable of being released by a tensile force acting on a constituent of the latching device away from the covering plate.

By virtue of the formation of the spring section with at least one elastically yielding spring tongue it is ensured that the elastic deformation path of the constituents from which the latching device is constructed, within which they guarantee a secure latching connection, is increased in comparison with known latching devices in the case of covering rosettes of the type mentioned in the introduction.

As regards the dimensional accuracy of the constituents of the covering rosette, less stringent demands are made overall than in the case of covering rosettes of the type mentioned in the introduction.

The spring section of an advantageous embodiment of the invention is formed by several elastically yielding spring tongues which are concentric with the passage openings and spaced from one another. By virtue of the plurality of spring tongues it is possible for the angular orientation of the ornamental hood in relation to the covering plate—in particular, in the normal case, the parallelism—to be adjusted well. By virtue of the fact that the spring tongues are distributed over a relatively large area, an unintentional gaping opening between ornamental hood and covering plate is avoided.

In another advantageous embodiment of the invention the latching device comprises two latching elements with latching faces matching one another and having several latching projections. With latching faces which are formed in this manner the latching device has several latching positions in the axial direction with respect to the passage opening. This enables the use of ornamental hoods with variable overall heights, which are all capable of being fastened securely by means of the same latching device. In addition, when one of the latching elements is connected to the flush-mounted fitting so as to be fixed with respect to the housing, by virtue of such a formation of the latching device the covering rosette can be mounted securely and in visually appealing manner, even with variable installation height of the flush-mounted fitting in a plumbing wall. The possibility of always using the same latching device results in cost savings in connection with the manufacture of the constituents of the covering plate.

The latching projections are preferably sawteeth. Latching projections of this type can be manufactured in straightforward manner and provide a secure support.

In a preferred embodiment of the invention the sawteeth are asymmetrical. By this means it is ensured that the expenditure of force is different when locking and releasing the latching connection of the latching device.

The sides of the sawteeth that are loaded in the course of attachment of the ornamental hood preferably include a smaller angle with the effective direction of the force than the sides of the sawteeth that are loaded in the course of detachment of the ornamental hood. The expenditure of force in the course of mounting is relatively slight, and the latching device is nevertheless securely connected, since the connection that is established by the latching device is released only after a limiting force has been overcome, the magnitude of which is greater than that of the mounting force.

This effect occurs in particularly pronounced manner if the sides of the sawteeth that are loaded in the course of detachment of the ornamental hood are perpendicular to the effective direction of the force. Such perpendicular surfaces provide a strong, safeguarding restraint in the effective direction against the force that is required for detaching the ornamental hood and are, at the same time, easy and inexpensive to manufacture.

In another advantageous embodiment of the invention the ornamental hood is resiliently biased in the latching device. The resilient biasing further reduces the requirements as regards the dimensional accuracy of the constituents of the covering rosette and holds the various parts in non-positive abutment at all times.

The ornamental hood preferably exhibits an edge surrounding its passage opening which separates a radially inner section which is concave when viewed from outside from a radially outer section which is convex when viewed from outside. By virtue of such a shaping of the ornamental hood its defined deformation in the course of the resilient biasing by the latching device is guaranteed. In addition, an ornamental hood which has been shaped in such a manner creates a visually appealing effect.

In another advantageous embodiment of the invention the latching device comprises a ring element which is coaxial with the passage opening of the covering plate and which exhibits at least one latching projection on its outer periphery. Latching projections can be easily fitted to a ring element of this type in the course of manufacture of the constituents of the covering rosette.

The ring element may be a component that is separate from the ornamental hood. As a result, the manufacture of the ornamental hood may be effected separately from the manufacture of the ring element. The ornamental hood may then consist, for example, of materials that are visually appealing but not suitable for the formation of latching projections.

In this connection the ring element preferably exhibits a radially protruding flange, the outside diameter of which is larger than the inside diameter of the passage opening of the ornamental hood. In this configuration the ornamental hood is held down in the mounted state by means of the ring element which exhibits the latching projection. In this case the ornamental hood does not have to exhibit any special fastening means.

The flange of the ring element may expediently exhibit recesses for receiving a tool head corresponding with it. With the aid of such a tool which engages in the recesses, both the mounting and the dismantling of the covering rosette are simplified.

Alternatively, the flange may exhibit an oval outer contour. Such a shaping of the flange is particularly suitable for receiving a tool with the aid of which a force is also to be transmitted in the peripheral direction of the ring element in the course of mounting or dismantling of the covering rosette.

In an alternative embodiment of the invention the ring element is non-detachably connected to the ornamental hood. The number of loose individual parts from which the as yet unmounted covering rosette is constructed is thereby reduced. This simplifies storage. In addition, with such a configuration the ring element and the ornamental hood are always securely connected to one another.

The ring element may also be integrally connected to the ornamental hood. This is advantageous in those cases in which a unified manufacturing process is possible. The ring element and the ornamental hood can then be produced in one manufacturing step.

In another advantageous embodiment of the invention the ring element exhibits a peripheral groove for receiving a gasket in the surface region facing towards the passage opening. With the aid of the gasket which is inserted into this peripheral groove the ring element protects the flush-mounted fitting against penetrating water.

The latching face of the ring element of another embodiment of the invention is constructed in the form of an external thread, and the latching face of the covering plate is constructed in the form of an internal thread corresponding thereto. Mounting or dismantling of the ornamental hood in this embodiment can optionally be performed with the aid of the screwing or unscrewing of the ring element or with the aid of a corresponding compressive or tensile force in the direction towards the ring element, which is coaxial with the passage opening of the ornamental hood. In this case the latching faces may also be so constructed that dismantling of the ornamental hood is only possible by unscrewing the ring element. By this means an undesirable release of the latching connection, for example as a result of internal stresses which arise, can be avoided.

The invention may be so configured that the covering plate comprises the spring section. In such an embodiment the spring tongues are fixed to the covering plate. The remaining constituents of the latching device then exhibit a relatively simple geometry and may accordingly be manufactured easily. The spring section is preferably integrally moulded on the covering plate.

The wall thickness of the spring tongues may be smaller than the wall thickness of the remaining covering plate onto which they are moulded. This smaller wall thickness has the result that the spring tongues can be bent relatively easily compared with the deformation of the covering plate. The elastically yielding shape of the spring tongues can consequently be manufactured easily.

The axial cross-section of the spring tongues with respect to the axis of the passage opening of the covering plate is preferably substantially U-shaped. Such a shaping of the spring tongues assists their elastic pliability.

In an alternative configuration of the invention the ring element comprises the spring section. By this means a covering plate can be realised with simple geometry. The spring section is preferably integrally moulded onto the ring element.

The wall thickness of the spring tongues may be smaller than the wall thickness of the remaining ring element onto which they are moulded, resulting in an elastically yielding ring element which is easy to manufacture.

In another embodiment of the invention the latching device exhibits a plurality of latching spigots which engage in latching structures pertaining to the covering plate and which are connected to the ornamental hood. In this case no ring element is required as a constituent of the covering rosette. The latching spigots may, in addition, be manufactured easily and cost-effectively.

In this connection the latching spigots are advantageously non-detachably connected to the ornamental hood. The covering rosette consequently consists of relatively few individual parts. In this case it is possible to dispense with separate fastening means which connect the latching spigots to the ornamental hood.

The latching spigots are preferably integrally connected to the ornamental hood. Manufacture of the ornamental hood together with the latching spigots in a single manufacturing step is made possible thereby. In addition, the position of the latching spigots on the ornamental hood is easy to predetermine in the course of manufacture.

In an advantageous construction the latching structures pertaining to the latching spigots which correspond with the latching structures pertaining to the covering plate are constructed as threads. Such latching structures can be easily fixed to the preformed latching-spigot bodies.

In another embodiment the latching structures pertaining to the covering plate engage the corresponding latching structures pertaining to the latching spigots only in a surface section which is situated on the outside with respect to the passage opening. In conjunction with the elastically yielding spring tongues the simple mounting or dismantling of the ornamental hood is guaranteed by the locking of the latching spigots in position in the latching device or the release of the latching spigots from the latching device, since the latching structures pertaining to the latching spigots which are situated on the inside with respect to the axis of the passage opening of the covering plate are not active relative to the covering plate.

BRIEF DESCRIPTION OF THE DRAWINGS

Examples of embodiments of the invention are elucidated in more detail below on the basis of the drawing; illustrated are.

DETAILED DESCRIPTION OF THE INVENTION

Figure 1:
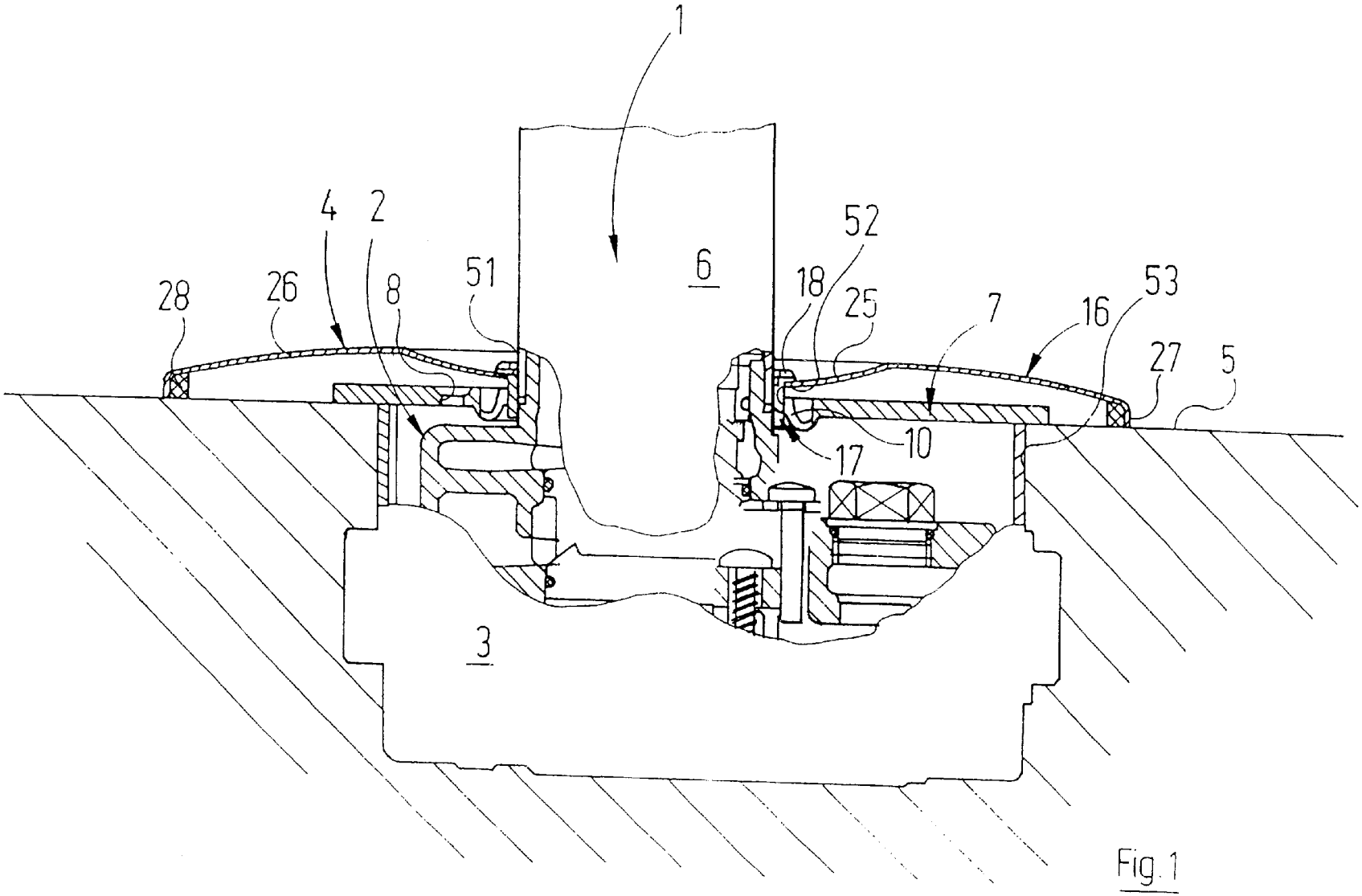
FIG. 1 a side view of a flush-mounted sanitary fitting, partially broken-open, with a covering rosette which exhibits a flat ornamental hood.

FIG. 1 shows a flush-mounted fitting 1, the housing 2 of which is located substantially in a flush-mounted box 3 which in turn is arranged in an installation opening 53 in a plumbing wall 5. A covering rosette which is designated overall by 4 covers the installation opening 53 in the upward direction. A region 6 of the flush-mounted fitting 1 is guided outwards through the covering rosette 4 in a manner which is yet to be described. The type and function of the flush-mounted fitting 1 are of no interest in the present context.

The covering rosette 4 exhibits a covering plate 7. The latter is fastened, via screws which are not represented in the drawing and which are inserted through passage bores 8 in the covering plate 7 (cf. also FIG. 4), to that region of the housing 2 of the flush-mounted fitting 1 which is located within the flush-mounted box 3.

Figure 4:
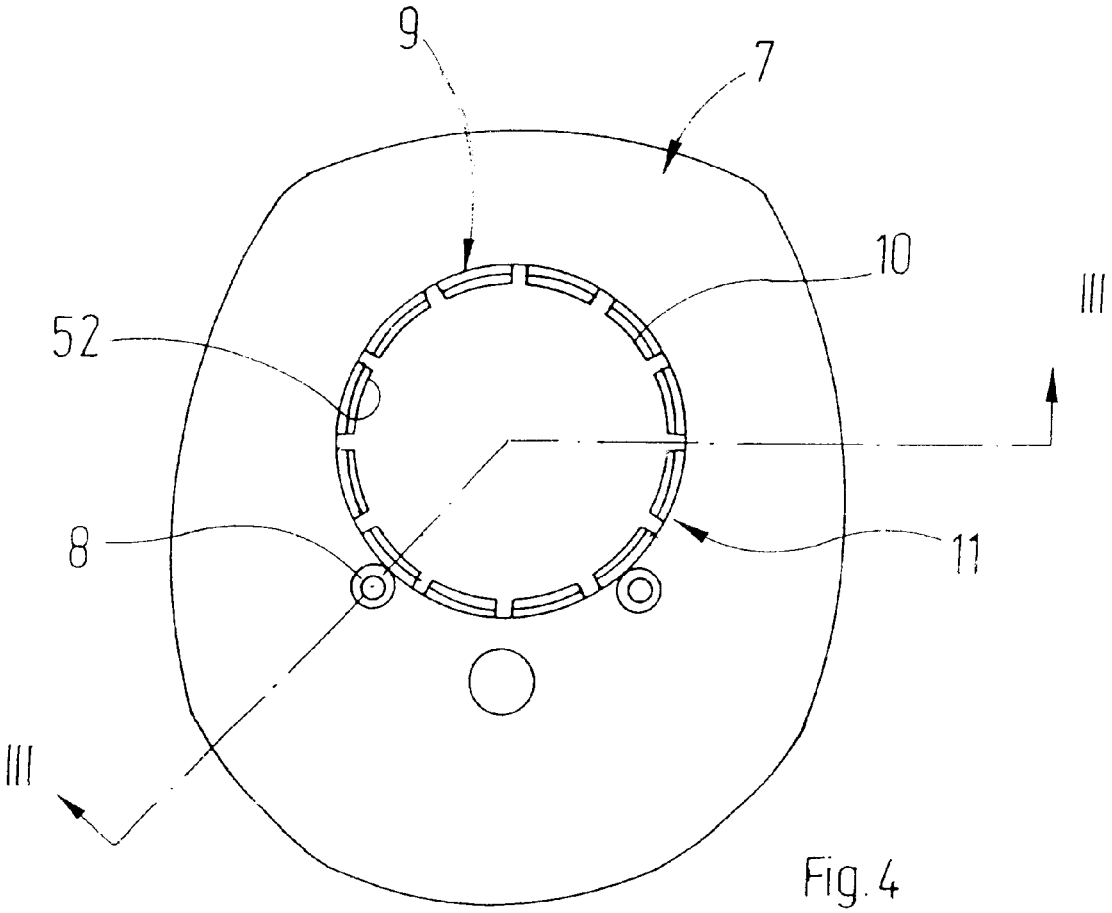
FIG. 4 a top view of a covering plate pertaining to the covering rosette shown in FIG. 1.

As can be gathered from FIG. 4, the covering plate 7 has the form of a substantially annular plate with a passage opening 52 for passing the region 6 of the flush-mounted fitting 1 through it.

The region of the covering plate 7 that faces the passage opening 52 exhibits a spring section which is designated overall by 9. The latter consists of a total of 12 spring tongues 10 having the shape of ring segments which are each separated by interspaces (cf. FIG. 4).

Figure 3:
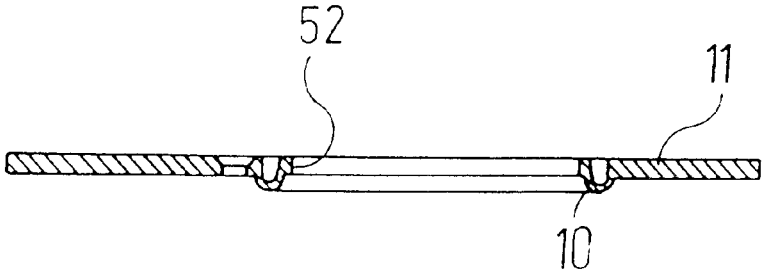
FIG. 3 a section through FIG. 4 according to line III—III.
Figure 5:
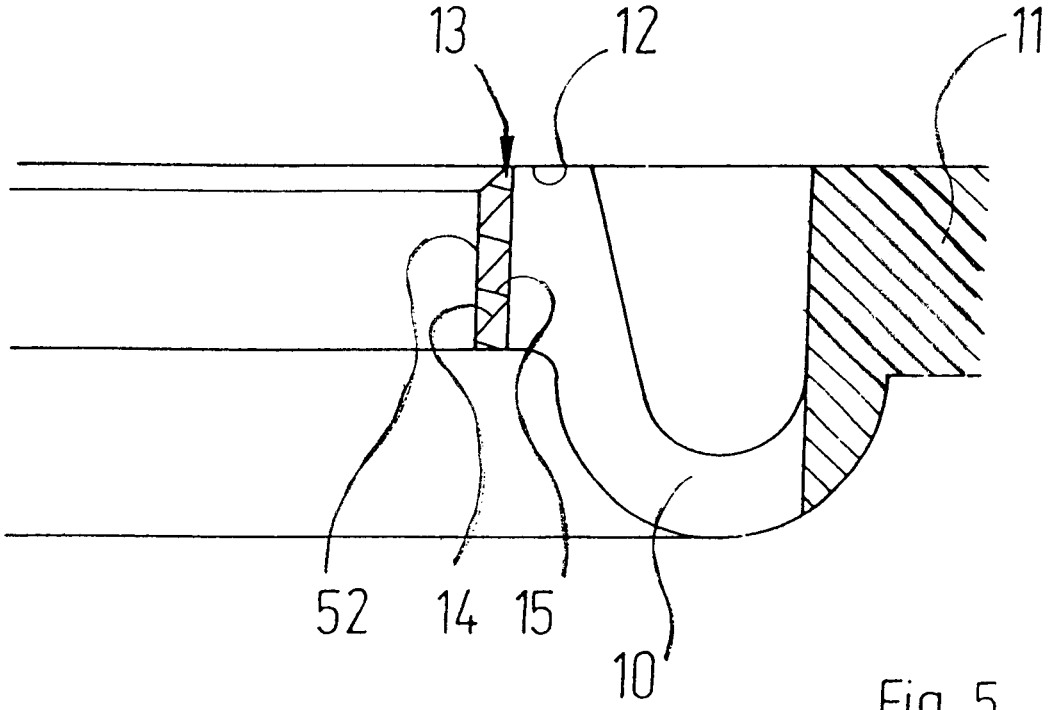
FIG. 5 an enlarged detail of a spring section of the covering plate shown in FIG. 3.
Figure 8:
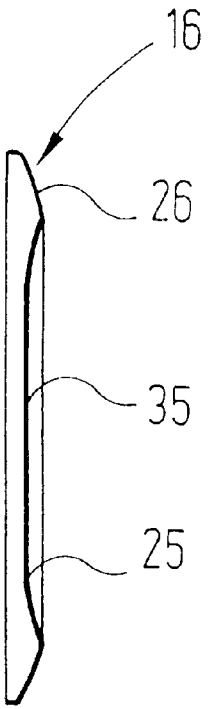
FIG. 8 a section through FIG. 6 according to line VIII—VIII.
Figure 6:
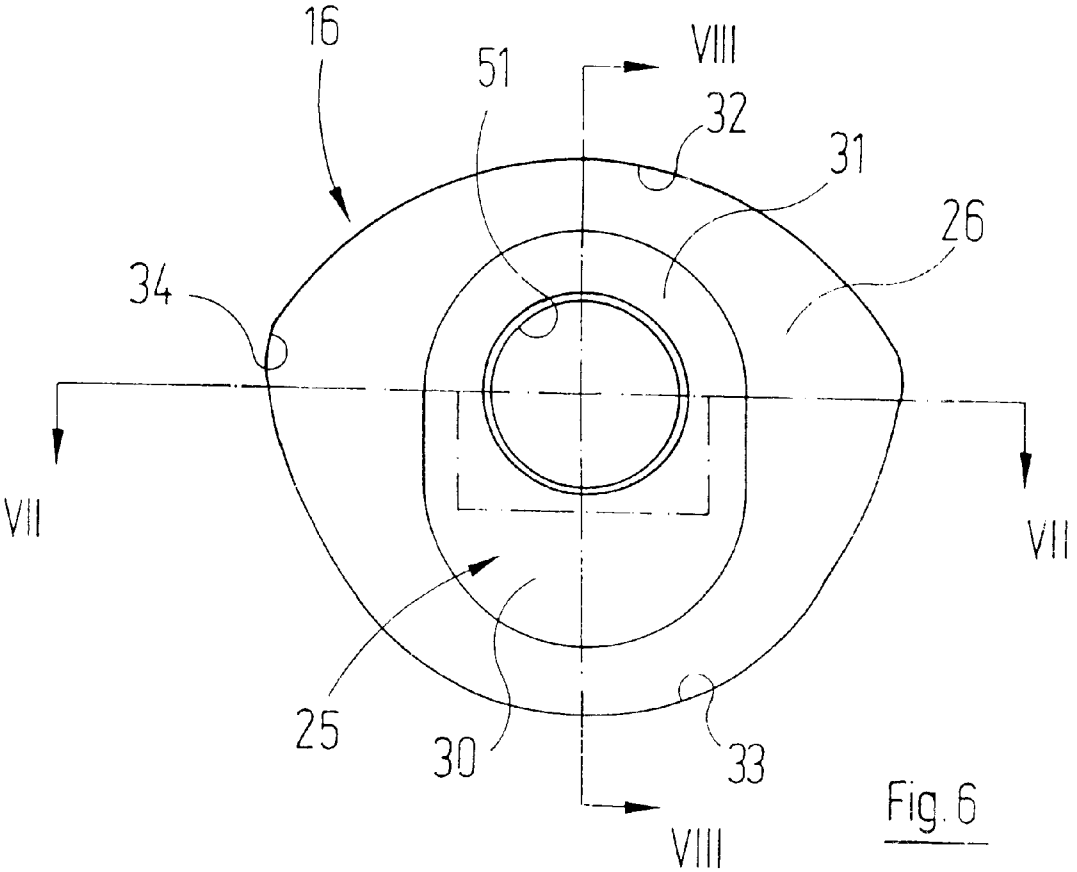
FIG. 6 a top view of an ornamental hood of the covering rosette shown in FIG. 1.
Figure 7:
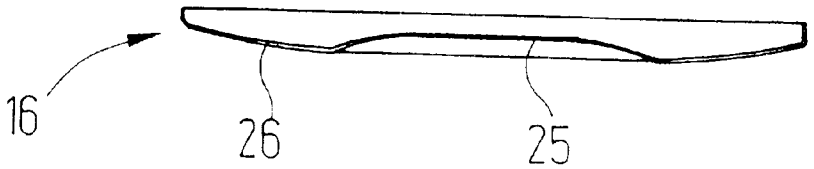
FIG. 7 a section through FIG. 6 according to line VII—VII.

The structure of a spring tongue 10 is shown by FIGS. 3 and 5. From an inner section 11 of the annular covering plate 7 radially towards the passage opening 52 the spring tongues 10 are moulded on approximately in the shape of a U in cross-section. In this connection the boundary surfaces 12 of the spring tongues 10 facing away from the plumbing wall 5 are aligned with the surface of the section 11 of the covering plate 7 which faces away from the plumbing wall 5, so that this surface of the covering plate 7 is flat. The curved section of the U points in the direction of the plumbing wall 5 and protrudes beyond the face of the covering plate 7 facing towards the plumbing wall 5. The representation in FIG. 5 shows that the wall thickness of the spring tongue 10 is smaller than that of the section 11 of the covering plate 7.

The totality of the spring tongues 10 forms the spring section 9 which is coaxial with the passage opening. The spring tongues 10 exhibit on their radially inner front face, i.e. in the region of the passage opening 52, a latching face taking the form of a latching structure 13 which exhibits sawteeth and takes the form of an internal thread. From FIG. 5 it can be gathered that sawtooth sides 14 that are inclined to a lesser degree in relation to the axis of the passage opening alternately follow, in each instance, sawtooth sides 15 that are inclined to a greater degree.

Figure 2:
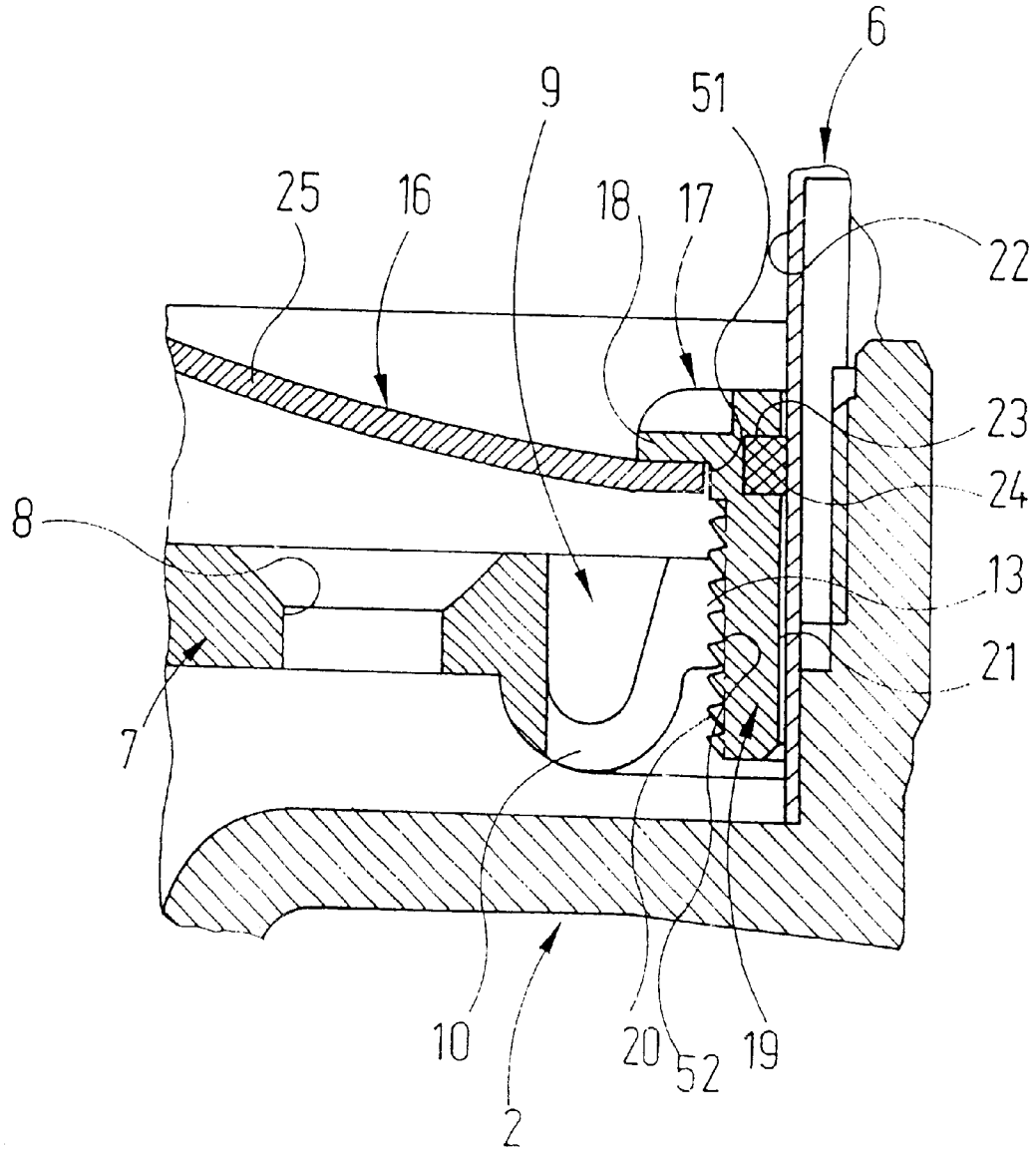
FIG. 2 an enlarged detail of a latching device pertaining to the covering rosette shown in FIG. 1.

As shown in FIGS. 1 and 2, an ornamental hood 16 pertaining to the covering rosette 4 is connected to the covering plate 7 via a latching device which is formed on the covering plate 7 and on the ring element 17. To this end the ring element 17 exhibits an axially outward-protruding flange 18 (cf. FIG. 2), the outside diameter of which is larger than the inside diameter of a passage opening 51 in the ornamental hood 16 surrounding the region 6 of the flush-mounted fitting 1. A section 19 of the ring element 17 having the form of a hollow cylinder which is set back radially in relation to the flange 18 exhibits a sawtooth-shaped latching structure 20 taking the form of an external thread which engages the latching structure 13 pertaining to the covering plate 7 which is complementary to the latching structure 20 pertaining to the ring element (cf. FIGS. 5 and 11).

The inner circumferential surface 21 of the ring element 17 abuts a corresponding outer circumferential surface 22 of the region 6 of the flush-mounted fitting 1. In order to prevent penetration of water, there is provided in the circumferential surface 21 of the ring element 17 a groove 23 by which a gasket 24 is received which abuts the outer circumferential surface 22 of the region 6 of the flush-mounted fitting 1.

As FIG. 1 shows, the ornamental hood 16 exhibits a radially inner section 25 which is lowered towards the region 6 of the flush-mounted fitting 1 in the direction of the plumbing wall 5 in concave manner when viewed from outside. In combination with a radially outer section 26, which is convex when viewed from outside, of the ornamental hood 16 the concave section 25 acts as an elastic region which abuts the holding-down flange 18 of the ring element 17 subject to bias.

The radially outer edge region 27 of the ornamental hood 16 abuts the plumbing wall 5 and at the same time encompasses a gasket 28 surrounding the installation opening 53 in such a way that no water is able to penetrate from the edge region 27 beneath the covering rosette 4.

Figure 11:
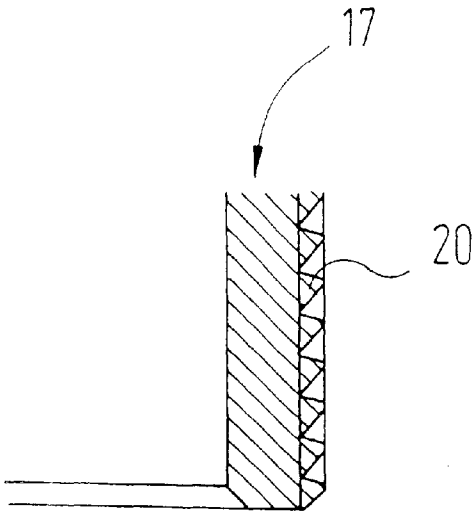
FIG. 11 an enlarged detail of the ring element shown in FIG. 9.
Figure 9:
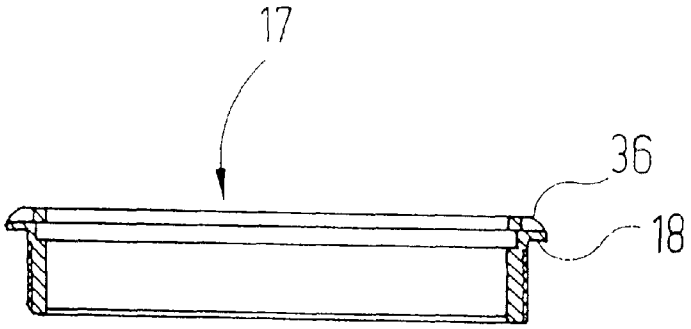
FIG. 9 a section through FIG. 10 according to line IX—IX.
Figure 10:
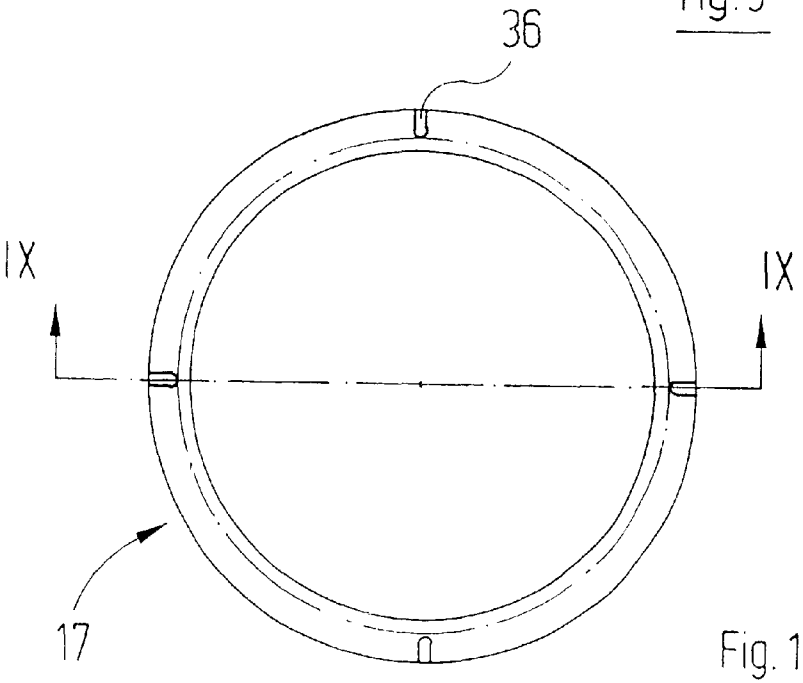
FIG. 10 a top view of a ring element pertaining to the covering rosette shown in FIG. 1.

FIGS. 9 to 11 show the ring element 17. The latter exhibits on its front face which is located at the top in FIG. 9 four radially outer recesses 36 which are equally spaced from one another and which serve to receive a tool for mounting and dismantling of the ornamental hood 16.

In the enlarged detail of FIG. 11 the shaping becomes clear of the sawtooth-shaped latching structure 20 which corresponds with that of the sawtooth-shaped latching structure 13 pertaining to the covering plate 7 (cf. FIG. 5).

The covering rosette 4 is mounted in the following way:

Firstly the covering plate 7 with the passage opening 52 is placed above the region 6 of the flush-mounted fitting 1 and is screw-coupled to the flush-mounted fitting 1 with screws (not represented in the drawing) which are guided through the passage openings 8. The ornamental hood 16 is placed with its passage opening 51 above the region 6 of the flush-mounted fitting 1 until the edge region 27 of the ornamental hood 1 abuts the plumbing wall 5. The edge region 27 of the ornamental hood 16 thereby presses a gasket 28 which is adjacent there against the plumbing wall 5.

The ring element 17 is then placed above the region 6 of the flush-mounted fitting 1. The unequal inclination, described above, of the sides 14 and 15 of the sawtooth-shaped latching structure 13 pertaining to the covering plate 7 and the corresponding pitches of the sides of the sawtooth-shaped latching structure 20 pertaining to the ring element 17 have the result that it is possible for the ring element 17 to be introduced from outside with a relatively small compressive force between the passage opening 52 in the covering plate 7 and the circumferential surface 22 of the region 6 of the flush-mounted fitting 1. In the course of introduction of the ring element 17 into the covering plate 7 the section 19 of said ring element slides past the spring section 9, tooth by tooth, until a secure support of the ornamental hood 16 is guaranteed by the flange 18, as described below. Whenever teeth pertaining to the two latching structures 13 and 20 are pressed past one another the spring section 9 which is elastic by virtue of the spring tongues 10 which are bent in a U-shape recedes radially outwards by a corresponding distance.

In the course of introduction of the ring element 17 the flange 18 of the ring element 17 firstly comes to abut the radially inner region of the section 25 of the ornamental hood 16. If the ring element 17 is pushed in further, the flange 18 presses the section 25 of the ornamental hood 16, contrary to the elastic spring force of said section, in the direction of the plumbing wall 5 and thereby tightens the ornamental hood 16 into a stable position.

Alternatively, instead of being pressed into the covering plate 7 the ring element 17 can also be screwed into the latter, since the latching structures 13 and 20 are threads that are complementary to one another.

In the course of dismantling the ornamental hood 16 a tool (not represented in the drawing) is applied to the ring element 17 in such a way that matching projections of the tool engage the recesses 36 of the ring element 17. With the aid of the tool the ring element 17 is unscrewed from the covering plate 7. The ring element 17, the ornamental hood 16 and, optionally, other structural elements may then be taken off.

Alternatively, the ring element 17 may also be removed by a tensile force acting away from the plumbing wall 5, which acts on the ring element 17. In the process the spring tongues 10 of the covering plate 7 yield radially outward by reason of the tensile force until the latching structures 13 and 20 are detached from one another.

Figure 12:
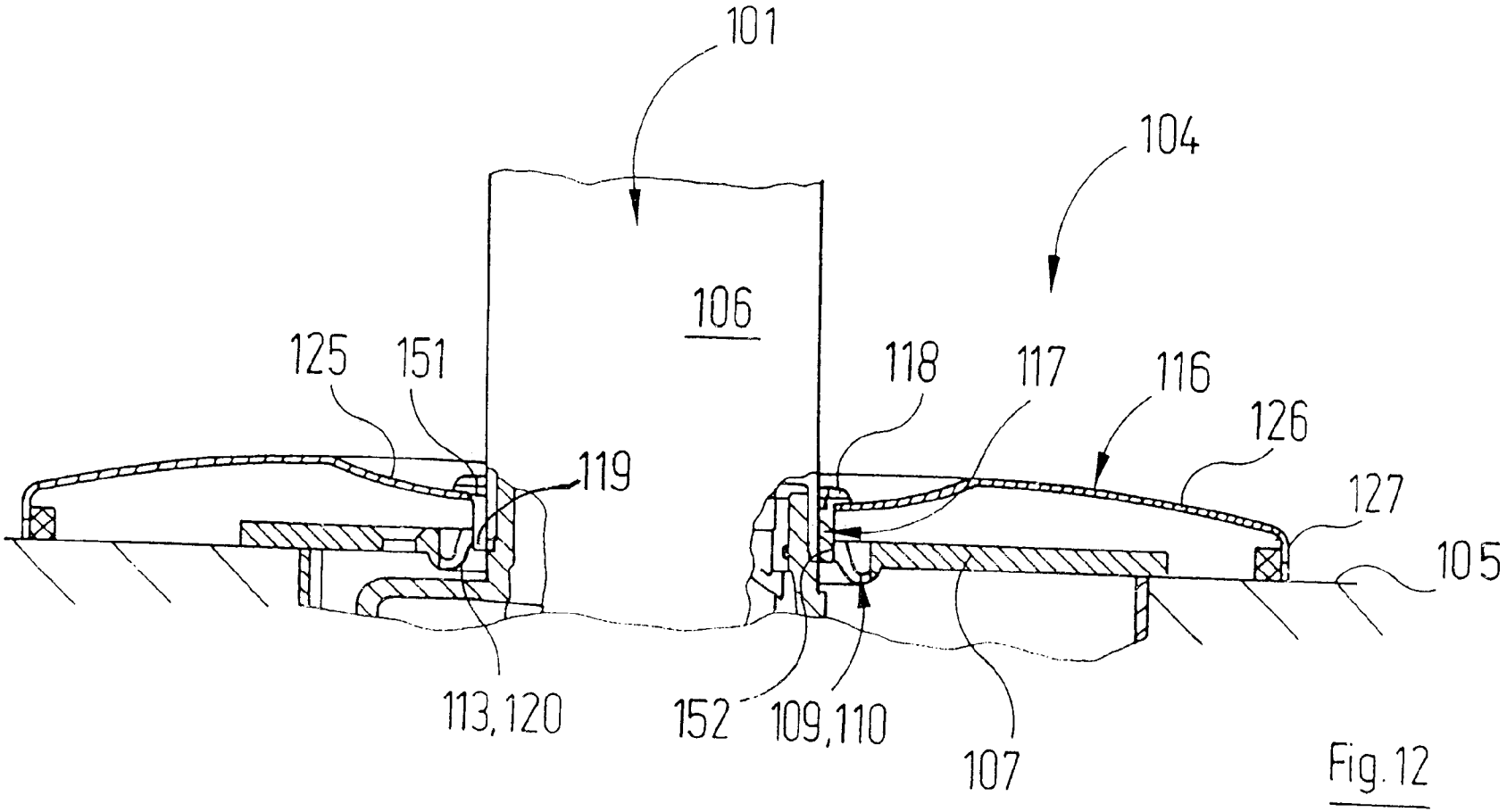
FIG. 12 an partial section of a covering rosette similar to that shown in FIG. 1 with a high ornamental hood.

FIG. 12 shows another example of an embodiment of the fastening of a covering rosette 104 to a flush-mounted fitting 101. The ornamental hood 116 shown in FIG. 12 differs from that shown in FIG. 1 in that it is of higher construction than the ornamental hood 16. The ornamental hood 116 is therefore also designated in the following as a "high" ornamental hood. The increased overall height is achieved by the radially outer edge region 127 of the high ornamental hood 116 which is perpendicular with respect to the plumbing wall 105 merging with a section 126 which is curved in domed manner only at a relatively large distance from the plumbing wall 105. Apart from this edge region 127 of higher construction, the other sections of the high ornamental hood 116, in particular the sections 125 and 126, are identical in shape to the sections 25 and 26 of the ornamental hood 16. In the course of mounting the covering rosette 104 the section 119 of the ring element 117 is therefore not pressed so deeply in the direction of the plumbing wall 105 into a latching structure 113 pertaining to the covering plate 107 as was the case in the course of mounting of the covering rosette 4. In other respects the mounting and dismantling of this embodiment are identical to the procedures described above.

Figure 13:
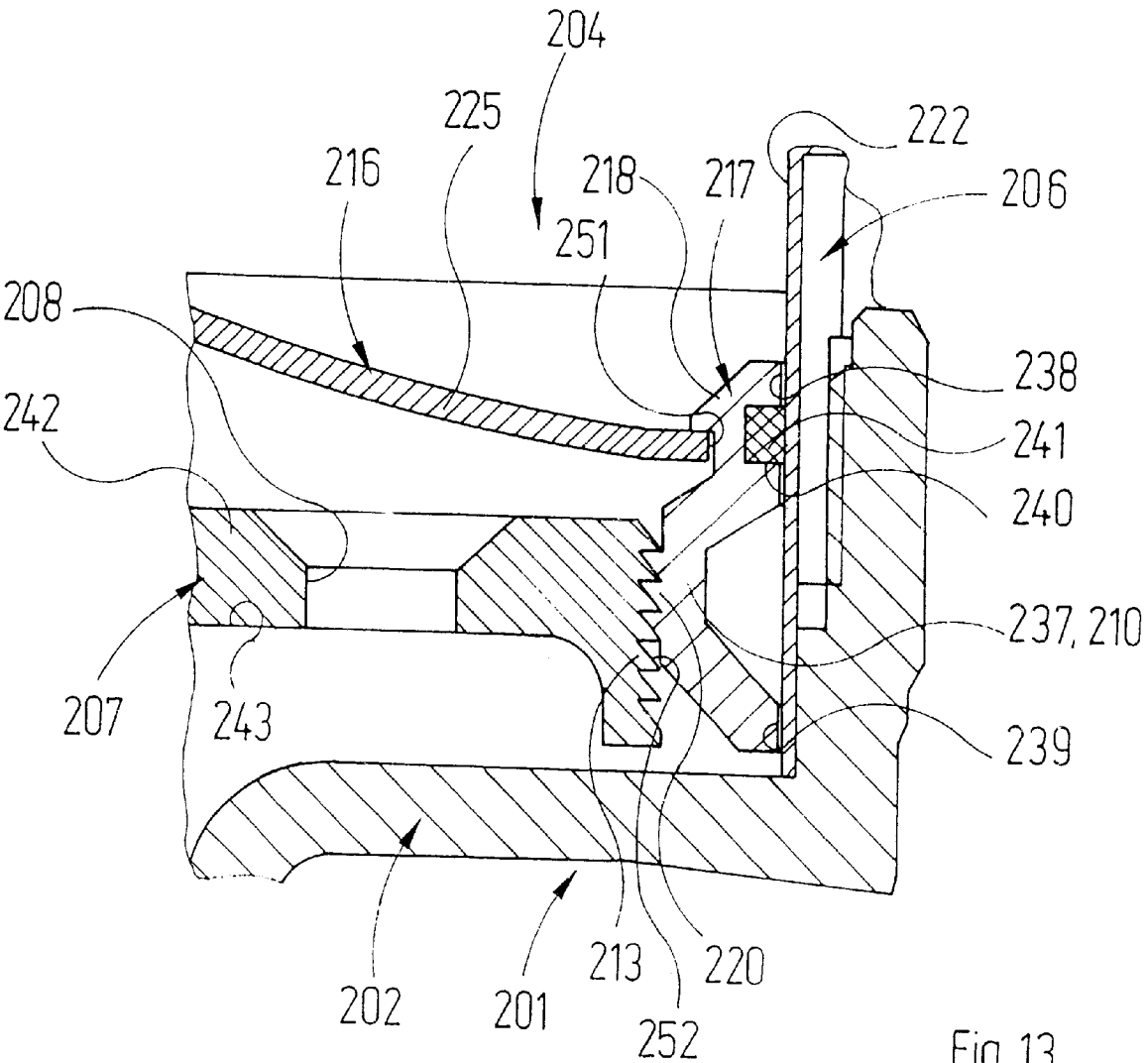
FIG. 13 a partial section, on an enlarged scale, of another embodiment of a covering rosette with a ring element exhibiting a spring section.

Another embodiment of a latching device for a covering rosette 204 is shown in FIG. 13. The ring element 217 bulges in a spring section 237 surrounding the region 206 of the flush-mounted fitting 201 away from the outer surface 222 of the region 206 in such a way that it only abuts the outer surface 222 of the region 206 with two annular bearing surfaces 238 and 239 which are axially spaced from one another. The spring section 237 is divided up, in a manner analogous to the spring sections 9 and 109 described above, into spring tongues 210 having the shape of ring segments.

In the bearing surface 238 there is formed, in addition, a groove 240 which receives a gasket 241. The latter abuts the outer surface 222 of the region 206 and in this way seals the ring element 217 in relation to the region 206 of the flush-mounted fitting 201.

The spring tongues 210 of the spring section 237 of the ring element 217 exhibit on their radially outer circumferential surface a sawtooth-shaped latching structure 220. The latter engages a corresponding sawtooth-shaped latching structure 213 pertaining to a covering plate 207. In contrast with the covering plates 7 and 107 described above, the covering plate 207 does not exhibit a spring section. The sawtooth-shaped latching structure 213 terminates on the side facing away from the plumbing wall 205 flush with the surface 242 of the covering plate 207. Towards the plumbing wall 205 the sawtooth-shaped edge structure 213 exhibits an axial enlargement which is greater than the wall thickness of the covering plate 207. The covering plate 207 likewise contains a passage bore 208 which serves to receive a screw, which is not represented, for fastening to the upper region of the housing 202 of the flush-mounted fitting 201.

In the course of mounting of an ornamental hood 216 the ring element 217 is pressed into the covering plate 207. In the process the spring section 237 is deformed in such a way that the outside diameter thereof is diminished in order to enable the latching structure 220 to slide past the latching structure 213. If the bracing of the ornamental hood 216 with the ring element 217 which is brought about by the flange 218 of the ring element 217 and the section 225 of the ornamental hood 216 (analogously to the mounting of the ornamental hood 16) is sufficient, the latching structures 213 and 220 latch together with one another, whereby they are pressed against one another by the spring action of the spring section 237.

In the course of dismantling of the ornamental hood 216 a tensile force is exerted on the ring element 217. In the process the spring section 237 is pressed flat in the direction of the region 206 of the flush-mounted fitting 201. By this means the outside diameter of the spring section 237 is diminished in such a way that the latching structures 213 and 220 can be detached from one another.

Figure 14:
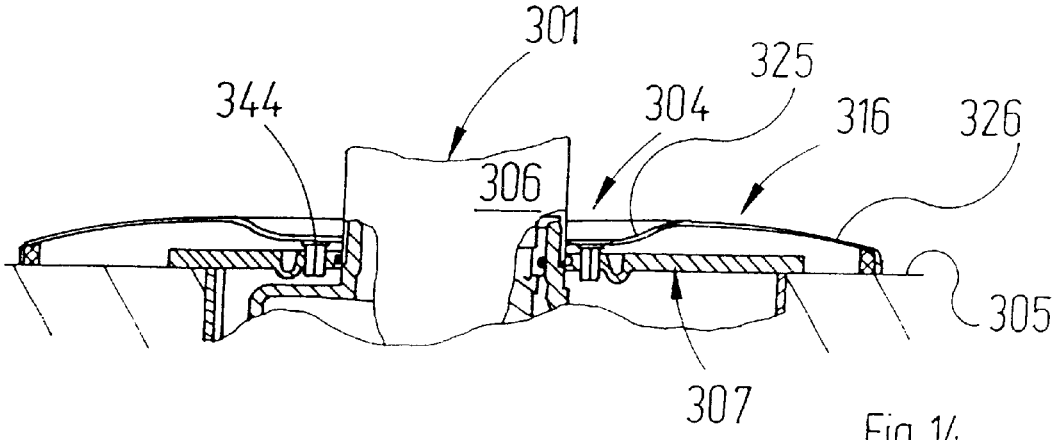
FIG. 14 a partial section of a covering rosette similar to that shown in FIG. 1, the ornamental hood of which is fastened via latching spigots.
Figure 15:
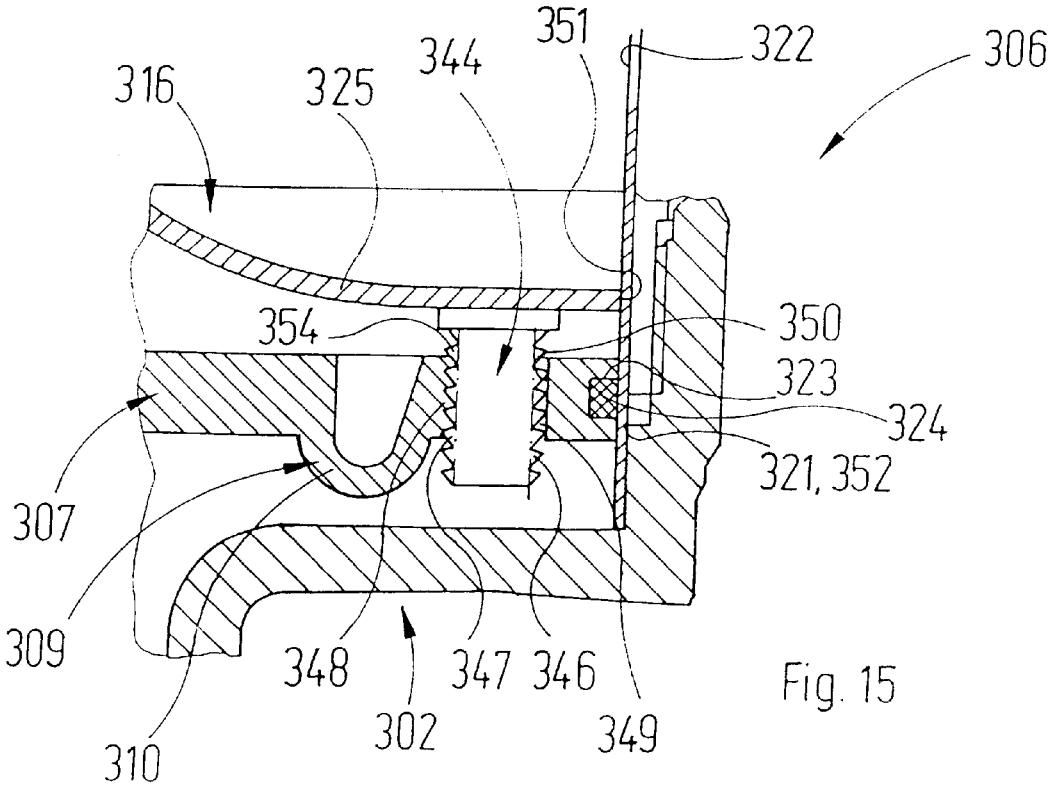
FIG. 15 an enlarged detail of a latching device pertaining to the covering rosette shown in FIG. 14.

In the case of the covering rosette 304 in FIGS. 14 and 15 another embodiment example of a fastening of an ornamental hood 316 to a covering plate 307 is shown. Here latching spigots 344 are fastened to a radially inner section 325 of the ornamental hood 316.

In the mounted state the longitudinal axis of the latching spigots 344 is parallel to the axis of the region 306 of the flush-mounted fitting 301. The circumferential surfaces 346 of the latching spigots 344 exhibit annular sawteeth 354. The latter have a contour analogous to that of the sawtooth-shaped latching structure 20 pertaining to the ring element 17 described above. A region 347 of the circumferential surface 346 pointing away from the axis of the region 306 engages a region 348 of the covering plate 307 exhibiting complementary sawteeth. A region 350 of the covering plate 307 likewise abuts a radially inner region 349 of the circumferential surface 346 of the latching spigot 344. Said region exhibits no sawteeth, however, but is of smooth construction.

Radially outside the region 348 the covering plate 307 exhibits a spring section 309 analogous to the spring section 9, with spring tongues 310.

The radial inner surface 321 with which the covering plate 307 abuts a corresponding radial outer surface 322 of the region 306 of the flush-mounted fitting 301 exhibits a groove 323 as well as a gasket 324 which seals in relation to this region 306.

In the course of mounting of the ornamental hood 316 the latter is pressed in the direction of the covering plate 307, whereby the latching spigots 344 slide into the openings in the covering plate 307 which are bounded by the regions 348 and 350. The pliability of the spring tongues 310 in the radial direction enables the latching structures pertaining to the regions 347 and 348 to slide past.

The ornamental hood 316 is dismantled by being removed from the covering plate 307. In the process the spring tongues 310 yield outwards in the radial direction and the connection of the latching structures pertaining to the regions 347 and 348 is released.

Embodiments of the covering rosette which are not represented in the drawing comprise latching structures with sawteeth exhibiting inclinations of the sides which differ from those described above, For instance,. one of the sawtooth sides may be perpendicular on the axis defined by the passage opening of the covering plate. The inclinations of the sides may also be constructed so that the tensile force that is required for dismantling the ornamental hood is less than the compressive force that is required in the course of mounting.

The latching structures of all the embodiments may, as described in connection with the embodiment example shown in FIG. 1, optionally take the form of threads or of closed, parallel ring structures.

In the latter case the latching device can only be closed by pressure and released by traction.

What is claimed is:

1. Covering rosette for a sanitary flush-mounted fitting with a covering plate which is capable of being fastened to the flush-mounted fitting and with an ornamental hood which is detachably fastened to the covering plate by means of a latching device, whereby covering plate and ornamental hood exhibit coaxial passage openings for a region of the flush-mounted fitting, characterised in that said latching device exhibits a spring section (9; 109; 237; 309) comprising at least one elastically yielding spring tongue (10; 110; 201; 310), which retains the ornamental hood (16; 116; 216; 316) by means of the latching device (7, 17; 107, 117; 207, 217; 307, 316) is capable of being released by a tensile force acting on a constituent (17; 117; 217; 316) of the latching device (7, 17; 107, 117; 207; 307, 316, 344) away from the covering plate (7; 107; 207; 307).

2. Covering rosette according to claim 1, characterised in that the spring section (9; 109; 237; 309) is formed by several elastically yielding spring tongues (10; 110; 210; 310) which are concentric with the passage openings (51, 52; 151, 152; 251, 252; 351, 352) and spaced from one another.

3. Covering rosette according to claims 1, characterised in that the latching device (7, 17; 107, 117; 207, 217; 307, 316, 344) comprises two latching elements with latching faces (13, 20; 113, 120; 213, 220; 347, 348) matching one another and having several latching projections.

4. Covering rosette according to claim 3, characterised in that the latching projections are sawteeth.

5. Covering rosette according to claim 4, characterised in that the sawteeth are asymmetrical.

6. Covering rosette according to claim 5, characterised in that the sides (14) of the sawteeth which are loaded in the course of attachment of the ornamental hood (16; 116; 216; 316) include a smaller angle with the effective direction of the force than the sides (15) of the sawteeth which are loaded in the course of detachment of the ornamental hood (16; 116; 216; 316).

7. Covering rosette according to claim 6, characterised in that the sides of the sawteeth which are loaded in the course of detachment of the ornamental hood (16; 116; 216; 316) are perpendicular to the effective direction of the force.

8. Covering rosette according to one of claim 1, characterised in that the ornamental hood (16; 116; 216; 316) is resiliently biased in the latching device (7, 17; 107, 117; 207, 217; 307, 317, 344).

9. Covering rosette according to claim 8, characterised in that the ornamental hood (16; 116; 216; 316) exhibits an edge surrounding its passage opening (51; 151; 251; 351) which separates a radially inner section (25, 125, 225, 325)

which is concave when viewed from outside from a radially outer section (26, 126, 326) which is convex when viewed from outside.

10. Covering rosette according to claim 1, characterised in that the latching device (7, 17; 107, 117; 207, 217) comprises a ring element (17; 117; 217) which is coaxial with the passage opening (52; 152; 252; 352) of the covering plate (7; 107; 207) and which exhibits on its outer periphery a latching surface (20; 120; 220) comprising at least one latching projection.

11. Covering rosette according to claim 10, characterised in that the ring element (17; 117; 217) is a component which is separate from the ornamental hood (16; 116; 216).

12. Covering rosette according to claim 11, characterised in that the ring element (17; 117; 217) exhibits a radially protruding flange (18, 118, 218), the outside diameter of which is larger than the inside diameter of the passage opening (51; 151; 251; 351) of the ornamental hood (16; 116; 216).

13. Covering rosette according to claim 12, characterised in that the flange (18; 118) exhibits recesses (36) for receiving a tool head corresponding therewith.

14. Covering rosette according to claim 12, characterised in that the flange exhibits an oval outer contour.

15. Covering rosette according to claim 10 or one of claims 12 to 14, characterised in that the ring element is non-detachably connected to the ornamental hood.

16. Covering rosette according to claim 15, characterised in that the ring element is integrally connected to the ornamental hood.

17. Covering rosette according to claim 10, characterised in that the ring element (17; 117; 217) exhibits in its inner circumferential surface (21) a peripheral groove (23) for receiving a gasket (24).

18. Covering rosette according to claim 10, characterised in that the latching face (20; 120; 220) of the ring element (17; 117; 217) is constructed as an external latching projection and the latching face (13; 113; 213) of the covering plate (7; 107; 207; 307) is constructed as an internal latching projection which is complementary thereto.

19. Covering rosette according to claim 10, characterised in that the covering plate (7; 107; 307) comprises the spring section (9; 109; 309).

20. Covering rosette according to claim 19, characterised in that the wall thickness of the spring tongues (10; 110; 310) is smaller than the wall thickness of the remaining covering plate (7; 107; 307) onto which they are moulded.

21. Covering rosette according to claim 19, characterised in that the axial cross-section of the spring tongues (10; 110; 310) with respect to the axis of the passage openings (51, 52; 151, 152; 351, 352) is substantially U-shaped.

22. Covering rosette according to claim 10, characterised in that the ring element (217) comprises the spring section (237).

23. Covering rosette according to claim 22, characterised in that the wall thickness of the spring tongues (210) is smaller than the wall thickness of the remaining ring element (217) onto which they are moulded.

24. Covering rosette according to claim 1, characterised in that the latching device (307, 316) exhibits a plurality of spigots (344) which engage in latching structures (348) pertaining to the covering plate (307) and which are connected to the ornamental hood (316).

25. Covering rosette according to claim 24, characterised in that the spigots (344) are non-detachably connected to the ornamental hood (316).

26. Covering rosette according to claim 24, characterised in that the spigots (344) are integrally connected to the ornamental hood (316).

27. Covering rosette according to claim 24, characterised in that the latching structures (346) pertaining to the spigots (344) and corresponding with the latching structures (348) pertaining to the covering plate (307) are constructed as threads.

28. Covering rosette according claim 24, characterised in that the latching structures (348) pertaining to the spring section (310) only engage a surface section (347) which is situated on the outside with respect to the passage opening (352) in the corresponding latching structures (346) pertaining to the spigots (344).

* * * * *